United States Patent [19]

Crook et al.

[11] Patent Number: 4,811,454

[45] Date of Patent: Mar. 14, 1989

[54] DOOR HOLDER

[76] Inventors: Tina Crook; Geraldine Crook, both of Rte. 1, Box 83B, Richmond Hill, Ga. 31324

[21] Appl. No.: 21,708

[22] Filed: Mar. 4, 1987

[51] Int. Cl.[4] ..... E05C 3/04

[52] U.S. Cl. ..... 16/82; 292/246

[58] Field of Search ..... 16/82, 86 R, 86 C, DIG. 17; 292/246, 264, 347, DIG. 2, DIG. 19

[56] References Cited

U.S. PATENT DOCUMENTS 1,739,940 12/1929 Basinger ..... 292/246

4,071,129 1/1978 Crabb ..... 292/246

*Primary Examiner*—Nicholas P. Godici

*Assistant Examiner*—Carmine Cuda

*Attorney, Agent, or Firm*—H. Jay Spiegel & Associates

[57] ABSTRACT

The present invention relates to an improved door holder which includes an elastic ring which is slipped over the door knob, a flexible belt which is mounted to an adjacent wall structure and a device in the likeness of an animal or creature which interacts with the belt and elastic ring to hold the door in an open position. The device may include a plurality of appendages, some of which may interact with the elastic ring while the belt is strapped about the body of the device so that the device holds the door ajar.

8 Claims, 1 Drawing Sheet

DOOR HOLDER

BACKGROUND OF THE INVENTION

The present invention relates to an improved door holder. In the prior art, door holders are well known but none is known by applicants which includes all of the features as set forth hereinbelow. The following prior art is known to applicants:

U.S. Pat. No. 990,114 to Crosskill discloses a latching device designed to hold a door in the open position and including a ring attached to the door which may interengage with an upright hook mounted on the wall. Of course, the teachings of the present invention are quite different from the teachings of Crosskill since the present invention utilizes an intermediate device which interengages between one member mounted on the wall and the other member mounted on the door knob.

U.S. Pat. No. 2,452,461 to Harris discloses a door latching mechanism including a hollow portion of one door knob having an upstanding ledge which may releasably interengage a hook member mounted on the wall. While this reference does disclose interaction with the door knob, again, the intermediate device is omitted.

U.S. Pat. No. 2,473,598 to Winter, et al. discloses a gate fastener including a ring which is releasably mountable over a gate post. Again, no intermediate device is used.

U.S. Pat. No. 4,159,837 to Morita discloses a door latching device which utilizes a hook interengageable with a knob head mounted on the door. Again, no intermediate device is used.

U.S. Pat. No. 4,269,439 to Warwick, et al. discloses a door holdback device which utilizes a cable formed into a loop which loop may be mountable about a latching cylinder to maintain the door in open configuration. While the loop of Warwick, et al. may be considered to have some similarity to the belt of the present invention, such similarity is only quite broad in nature since again no intermediate device is used.

SUMMARY OF THE INVENTION

The present invention overcomes the deficiencies of prior art door holders by providing an improved door holder which combines functional aspects with aesthetic aspects. The present invention includes the following interrelated aspects and features:

(a) In a first aspect of the present invention, an elastic ring is provided which may be stretched over a door knob and then may contract to be securely fastened about the neck of the door knob. Attached to the elastic ring are a pair of fastening devices which are attached to the elastic ring by virtue of elongated members.

(b) Attached to the wall adjacent the location where the door knob will be located when the door is open is a bracket having attached thereto a belt. In the preferred embodiment, the belt has a loop at each end with one loop being securely fastened to the bracket and with the other loop being detachably fastenable to the other loop side of the bracket so that with the other loop so attached to the bracket, the belt forms an enclosure between the belt and the wall where the bracket is mounted.

(c) A third component of the present invention consists of a device which may be made in the likeness of an animal, creature, human being, etc. The device includes an elongated body having arms and legs and a head and may, if desired, include a tail. The device may be interengaged between the belt, bracket and elastic ring fasteners by first fastening the belt about the waist of the creature and thereafter the fasteners of the elastic ring may be fastened to the arms of the creature about the wrists thereof to thereby fix the position of the door knob and thereby the door with respect to the adjacent wall structure.

Accordingly, it is a first object of the present invention to provide an improved door holding device.

It is a further object of the present invention to provide such an improved door holding device including a wall bracket, a door knob ring and a device interposed therebetween.

It is a further object of the present invention to provide such an improved door holding device wherein the device interposed between the bracket and the elastic ring may have aesthetic pleasing features.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 4:
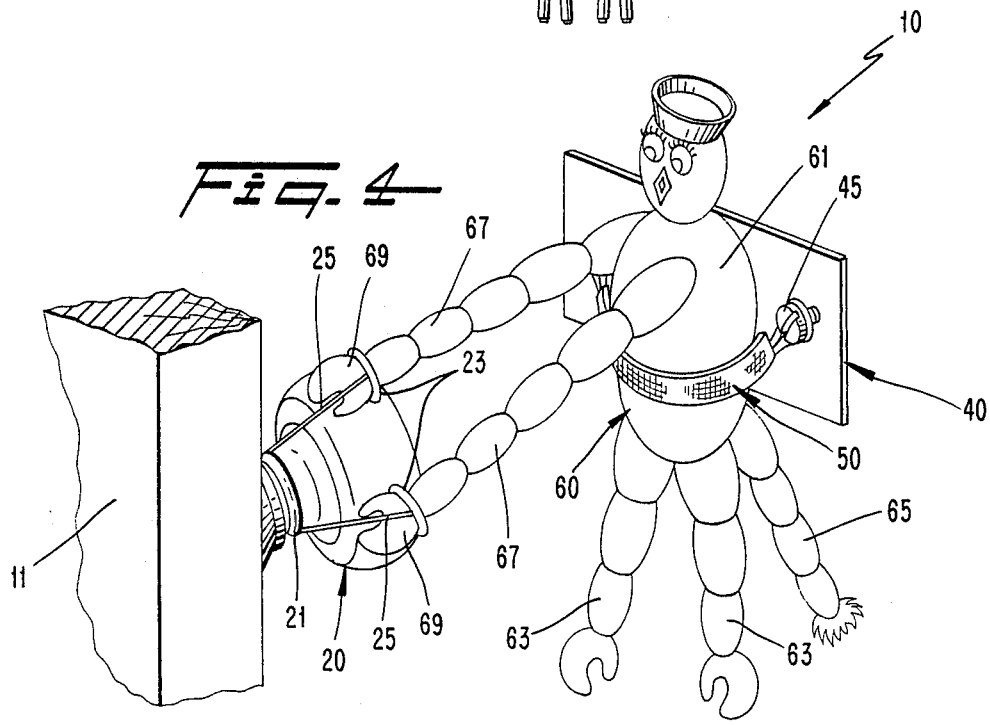
FIG. 4 shows a perspective view of the device of FIGS. 1 and 2 as well as the device of FIG. 3 with these devices having interposed therebetween an interconnecting device.

With reference, first, to FIG. 4, the present invention is generally designated by the reference numeral 10 and includes an elastic ring portion 20, a bracket, belt portion 40 and an interconnection device 60.

Figure 1:
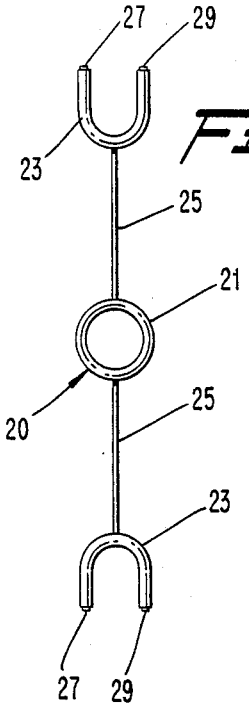
FIG. 1 shows a side view of an elastic ring with attached fasteners of the present invention.

With reference to FIG. 1, it is seen that the elastic ring portion 20 includes and elastic ring 21, and two U-shaped fasteners 23 which are connected to the elastic ring 21 by respective strings 25. Each fastener 23 includes snap halves 27, 29 which may be snapped together so that each fastener 23 may enclose an object.

Figure 2:
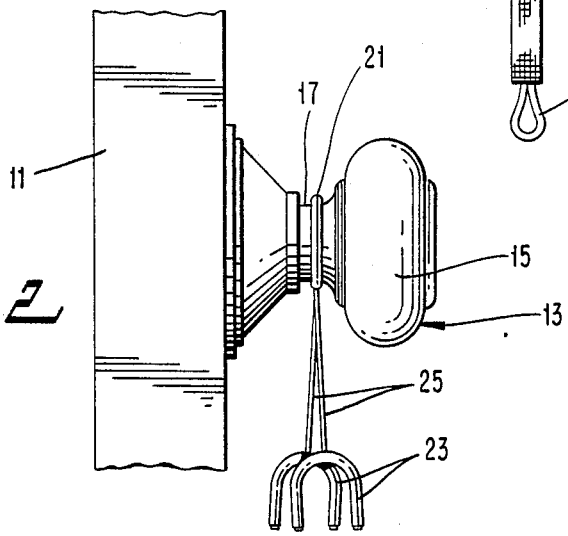
FIG. 2 shows the aspect of the present invention shown in FIG. 1 as affixed to a door knob.

FIG. 2 shows a door 11 having a door knob 13 composed of a head portion 15 and a neck portion 17. The elastic ring 21 is seen stretched over the head 15 and resiliently engaging the neck 17 of the door knob 13 in mounted position.

Figure 3:
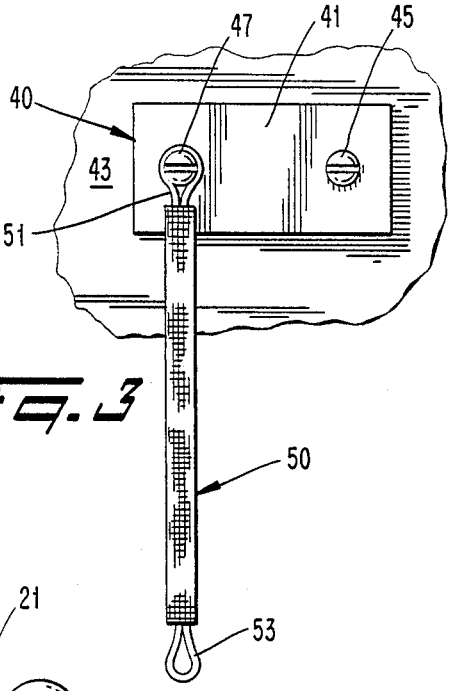
FIG. 3 shows another aspect of the present invention comprising a bracket having attached thereto an elongated belt.

With reference to FIG. 3, a bracket, belt portion 40 is seen to include a bracket 41 mounted to the adjacent wall 43 by screws 45, 47 with the screw 47 securing a loop 51 of the belt 50 in place. The belt 50 includes a second loop 53 which may be looped over the screw 45, which screw 45 is not completely fastened into the wall 43 to leave a slight annular space between the screw 45 and the bracket 41.

With reference to FIG. 4, the interconnection device 60 is seen to include a body 61, legs 63, a tail 65 and arms 67 having enlarged hands 69. As seen in FIG. 4, the fasteners 23 may be snapped about the wrists of the arms 67 of the device 60 and when so snapped create an opening smaller than the outer dimensions of the hands 69 so that the hands are retained to one side of the fasteners 23 as shown in FIG. 4.

With further reference to FIG. 4, it is seen that the belt 50 is mounted about the waist of the body 61 of the interconnection device 60 to securely fasten the device 60 to the bracket 40. Thus, in the position shown in FIG. 4, the device 60 is securely fastened to the bracket 40 by the belt 50 while the arm 67 of the device 60 are securely fastened to the fasteners 23 which are interconnected with the elastic ring 21. In this way, the door 11 is secured in an open position.

When it is desired to allow the door to be closed, the belt 53 may be unhooked from the screw 45 to allow the device 60 to dangle freely from the neck 17 of the door knob 13 so that the door may easily close. Alternatively, the device 10 may be released by uncoupling the fasteners 23 by unsnapping the snaps 27, 29 thereof. In this mode of operation, the device 60 will be retained on the bracket 40 by the belt 50.

Of course, the device 60 may be made in the likeness of any object, creature or other thing and need not be simulative, however, the preferred embodiment of the present invention includes this simulative aspect since simulation of a creature makes the invention more interesting. Accordingly, while the device 60 may be made in any shape or form, it is preferred that it be made in the likeness of some creature or animal.

Accordingly, an invention has been disclosed in terms of a preferred embodiment thereof which fulfills each and every one of the objects as set forth hereinabove. Of course, various changes, modifications and alterations in the teachings of the present invention may be contemplated by those skilled in the art without departing from the intended spirit and scope of the present invention. Accordingly, it is intended that the present invention only be limited by the terms of the appended claims.

We claim:

1. An improved door holder comprising:
(a) a ring member connectable to a door knob attached to a door;
(b) a bracket member attached to a wall adjacent to said door knob in an open position of said door; and
(c) interconnection means for releasable interconnection between said ring member and bracket member to releasably hold said door in said open position;
(d) said ring member including a flexible ring stretchable over said door knob and at least one elongated fastener connected to said ring at one end thereof and releasably connectable to said interconnection means at another end thereof.

2. The invention of claim 1, wherein said bracket member includes a bracket attached to said wall and a belt having one end fixed to said bracket and another end removably attached to said bracket, said belt and bracket defining therebetween a loop when said belt another end is attached to said bracket, said loop retaining said interconnection means therein.

3. The invention of claim 2, wherein said interconnection means includes a body releasably retainable by said loop.

4. The invention of claim 1 wherein said interconnection means includes a body releasably attached to said bracket member and an elongated arm attached to said body and releasably fastenable to said elongated fastener.

5. The invention of claim 4, wherein said body comprises a likeness of a creature and said arm comprising a likeness of an arm of said creature.

6. The invention of claim 1, wherein said interconnection means comprises a simulation of a creature having a torso, arms, legs and a head, said torso being releasably fastenable to said bracket member, at least one of said arms being releasably fastenable to said ring member.

7. An improved door holder comprising:
(a) a ring member connectable to a door knob attached to a door;
(b) a bracket member attached to a wall adjacent to said door knob in an open position of said door; and
(c) interconnection means for releasable interconnection between said ring member and bracket member to releasably hold said door in said open position;
(d) said bracket member including a bracket attached to said wall and a belt having one end fixed to said bracket and another end removably attached to said bracket, said belt and bracket defining therebetween a loop when said belt another end is attached to said bracket, said loop retaining said interconnection means therein.

8. An improved door holder comprising:
(a) a ring member connectable to a door knob attached to a door;
(b) a bracket member attached to a wall adjacent to said door knob in an open position of said door; and
(c) interconnection means for releasable interconnection between said ring member and bracket member to releasably hold said door in said open position;
(d) said interconnection means comprising a simulation of a creature having a torso, arms, legs, and a head, said torso being releasably fastenable to said bracket member, at least one of said arms being releasably fastenable to said ring member.

* * * * *